US011551830B2

(12) United States Patent
Kaczmarski et al.

(10) Patent No.: US 11,551,830 B2
(45) Date of Patent: Jan. 10, 2023

(54) TELECOMMUNICATIONS CABLE WITH TWIN JACKET AND BARRIER

(71) Applicant: Sterlite Technologies Limited, Aurangabad (IN)

(72) Inventors: Andrew Kaczmarski, Casula (AU); Abhishek Upadhyay, Aurangabad (IN); Noufal Kazhhungum Thottathil, Aurangabad (IN); Darshana Bhatt, Aurangabad (IN)

(73) Assignee: Sterlite Technologies Limited, Gurgaon (IN)

( * ) Notice: Subject to any disclaimer, the term of this patent is extended or adjusted under 35 U.S.C. 154(b) by 0 days.

(21) Appl. No.: 17/256,019

(22) PCT Filed: Nov. 19, 2019

(86) PCT No.: PCT/IN2019/050855
§ 371 (c)(1),
(2) Date: Dec. 24, 2020

(87) PCT Pub. No.: WO2020/105066
PCT Pub. Date: May 28, 2020

(65) Prior Publication Data

US 2021/0272720 A1 Sep. 2, 2021

(51) Int. Cl.
*H01B 11/02* (2006.01)
*H01B 11/10* (2006.01)
*H01B 11/04* (2006.01)

(52) U.S. Cl.
CPC ..... *H01B 11/10* (2013.01); *H01B 11/04* (2013.01)

(58) Field of Classification Search
CPC ..... H01B 11/02; H01B 11/04; H01B 11/06; H01B 11/10
USPC ..... 174/110 R, 113 R, 113 C, 113 AS, 115, 174/116
See application file for complete search history.

(56) References Cited

U.S. PATENT DOCUMENTS

| | | | | |
|---|---|---|---|---|
| 6,800,811 | B1 * | 10/2004 | Boucino | H01B 11/06 174/113 C |
| 6,998,537 | B2 * | 2/2006 | Clark | H01B 11/04 174/113 R |
| 7,196,271 | B2 * | 3/2007 | Cornibert | H01B 11/06 174/113 C |
| 9,159,471 | B2 * | 10/2015 | Nordin | H01B 13/00 |
| 9,748,022 | B2 * | 8/2017 | Gareis | H01B 7/0225 |
| 2007/0037419 | A1 * | 2/2007 | Sparrowhawk | H01B 11/1008 439/98 |

(Continued)

*Primary Examiner* — William H. Mayo, III
(74) *Attorney, Agent, or Firm* — Steven R. Fairchild; Michael J. Pennington

(57) ABSTRACT

A telecommunications cable includes a plurality of twisted pairs of insulated conductors, a separator, a first jacket, one or more barriers and a second jacket. In addition, the plurality of twisted pairs of insulated conductors extends substantially along a longitudinal axis of the telecommunications cable. Further, the plurality of twisted pairs of insulated conductors includes an electrical conductor and an insulation layer. Furthermore, the separator separates each of the plurality of twisted pairs of insulated conductors. Moreover, the first jacket and the second jacket extend substantially along the longitudinal axis of the telecommunications cable. Also, the one or more barriers are positioned between the first jacket and the second jacket.

10 Claims, 2 Drawing Sheets

(56) References Cited

U.S. PATENT DOCUMENTS

2007/0102188 A1* 5/2007 Glew ..... H01B 3/445
174/113 C

* cited by examiner

TELECOMMUNICATIONS CABLE WITH TWIN JACKET AND BARRIER

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

BACKGROUND OF THE INVENTION

Field of the Invention

The present disclosure relates to the field of telecommunications cables. More particularly, the present disclosure relates to a telecommunications cable with piranha separator and twin jacket including special barrier.

Description of the Related Art

With an increase in utilization of complex communication and networking systems, the demand for transmitting signals at high transmission rates has increased. In order to meet the growing demands, various types of data transmission cables are used for transmitting data which are compliant with high performance data standards. These data transmission cables are classified into UTP (Unshielded Twisted Pair) cables, FTP (Foiled Twisted Pair) cables and STP (Shielded Twisted Pair) cables depending on the shield. UTP cable is the widely used data transmission cable in which one or more twisted pairs of insulated conductors are bundled within an outer jacket. In addition, the UTP cables include filler or separator. The shape of the separator may be cross type. The filler or separator forms four regions for disposing the twisted pair of insulated conductors. Typically, the one or more twisted pairs of insulated conductors along with other components like separators, ripcords etc. defines a cable core of the data transmission cable. The cable core is surrounded by the outer jacket extruded circumferentially over the cable core to provide mechanical strength and protection to the cable core.

A common problem in the data transmission cable is an increased occurrence of an alien crosstalk associated with high speed signal transmission especially for augmented categories such as Cat 6A, Cat 7A and Cat 8. Conventional data transmission cables with conventional outer jacket do not comply with stringent alien cross talk testing of the cable. In general, alien crosstalk is an electromagnetic noise that occurs in a data transmission cable which runs alongside one or more other data transmission cables. Moreover, the conventional jacket does not protect movement of conductor pairs inside the cable. Further, the conventional jacket does not provide firm packing of bunched conductor pairs inside the cable. Furthermore, the conventional jacket does not support alignment of the separator with the conductor pairs. Also, the conventional jacket does not provide higher margin of Near End cross talk parameter. In addition, the conventional jacket does not provide stable and lower insertion loss. In light of the above stated discussion, there exists a need for a telecommunications cable which overcomes the above cited drawbacks of conventionally known telecommunications cable.

BRIEF SUMMARY OF THE INVENTION

In an aspect, the present disclosure provides a telecommunications cable. The telecommunications cable includes a plurality of twisted pairs of insulated conductors. In addition, the plurality of twisted pairs of insulated conductors extends substantially along a longitudinal axis of the telecommunications cable. Further, each insulated conductor of the plurality of twisted pairs of insulated conductors includes an electrical conductor. The electrical conductor is made of copper. Furthermore, each insulated conductor of the plurality of twisted pairs of insulated conductors includes an insulation layer surrounding the electrical conductor. The insulation layer is made of a material selected from a group of polyolefin and fluoropolymer. Moreover, the telecommunications cable includes a separator. The separator separates each of the plurality of twisted pairs of insulated conductors. Also, the telecommunications cable includes a first jacket and a second jacket. The first jacket and the second jacket extend substantially along the longitudinal axis of the telecommunications cable. Also, the telecommunications cable includes one or more barriers. The one or more barriers are positioned between the first jacket and the second jacket. The one or more barriers partially surrounds the first jacket.

A primary object of the present disclosure is to provide a telecommunications cable with piranha separator and a twin jacket with special barrier for reduction of cable diameter.

Another object of the present disclosure is to provide the telecommunications cable for protection of electrical conductors from any external impact.

Yet another object of the present disclosure is to provide the telecommunications cable with reduced alien cross talk.

Yet another object of the present disclosure is to provide the telecommunications cable with reduced barrier material consumption.

Yet another object of the present disclosure is to provide the telecommunications cable with firm packing of conductor pairs inside separator segments.

Yet another object of the present disclosure is to provide the telecommunications cable to enable better cable fill capacity during field installations.

Yet another object of the present disclosure is to provide the telecommunications cable with proper alignment of separator with conductor pairs against jacket.

Yet another object of the present disclosure is to provide the telecommunications cable with higher margin of Near End Crosstalk parameter.

In an embodiment of the present disclosure, the one or more barriers are placed longitudinally between the first jacket and the second jacket to partially surround the first jacket.

In an embodiment of the present disclosure, the one or more barriers are made of Polyester-Aluminium Polyester material (PET-AL-PET).

In an embodiment of the present disclosure, the one or more barriers are made of the Polyester-Aluminium Polyester material (PET-AL-PET). In addition, the Polyester-Aluminium Polyester material (PET-AL-PET) has a first material layer, a second material layer, and a third material layer. The first material layer, the second material layer, and the third material layer are continuous thin films. Further, the first material layer has a thickness in a range of about 12 micron±5 micron. Furthermore, the second material layer has a thickness in a range of about 25 micron±10 micron. Moreover, the third material layer has a thickness in a range of about 12 micron±5 micron.

In an embodiment of the present disclosure, each of the one or more barriers has a width of at least 5 millimeter.

In an embodiment of the present disclosure, the plurality of twisted pairs of insulated conductors includes an insulation layer. In addition, the insulation layer is made of a material selected from a group of fluoropolymer and polyolefin.

In another aspect, the present disclosure provides a telecommunications cable. The telecommunications cable includes a plurality of twisted pairs of insulated conductors. In addition, the plurality of twisted pairs of insulated conductors extends substantially along a longitudinal axis of the telecommunications cable. Further, the telecommunications cable includes a first jacket and a second jacket. The first jacket and the second jacket extend substantially along the longitudinal axis of the telecommunications cable. Furthermore, the telecommunications cable includes a separator. The separator includes a first separator arm extending along a length of the telecommunications cable. In addition, the separator includes a second separator arm extending along the length of the telecommunications cable. Further, the first separator arm and the second separator arm are positioned perpendicular to each other. Furthermore, the first separator arm and the second separator arm of the separator include a cylindrical section, and two triangular sections. Moreover, the cylindrical section, and the two triangular sections form a dumbbell shape structure. Also, the two triangular sections have piranha teeth like structure on its edge extending along the length of the telecommunications cable.

In an embodiment of the present disclosure, consecutive teeth of the piranha teeth like structure on the edge of the two triangular sections has a distance in a range of about 0.10 millimeter to 1.09 millimeter. The piranha teeth like structure on the edge of the two triangular sections has a height in a range of about 0.09 millimeter to 0.8 millimeter.

In yet another aspect, the present disclosure provides a telecommunications cable. The telecommunications cable includes a first jacket and a second jacket. In addition, the first jacket and the second jacket extend substantially along a longitudinal axis of the telecommunications cable. Further, the first jacket and the second jacket are made of a material selected from a group consisting of low smoke zero halogen material, polyvinyl chloride material, and any other polymer material. Furthermore, one or more barriers are positioned between the first jacket and the second jacket. Moreover, the one or more barriers have a width of at least 5 millimeter.

In an embodiment of the present disclosure, the first jacket and the second jacket have a thickness in a range of about 0.5±0.4 millimeter.

DESCRIPTION OF THE DRAWINGS

In order to best describe the manner in which the above-described embodiments are implemented, as well as define other advantages and features of the disclosure, a more particular description is provided below and is illustrated in the appended drawings. Understanding that these drawings depict only exemplary embodiments of the invention and are not therefore to be considered to be limiting in scope, the examples will be described and explained with additional specificity and detail through the use of the accompanying drawings in which.

Figure 1:
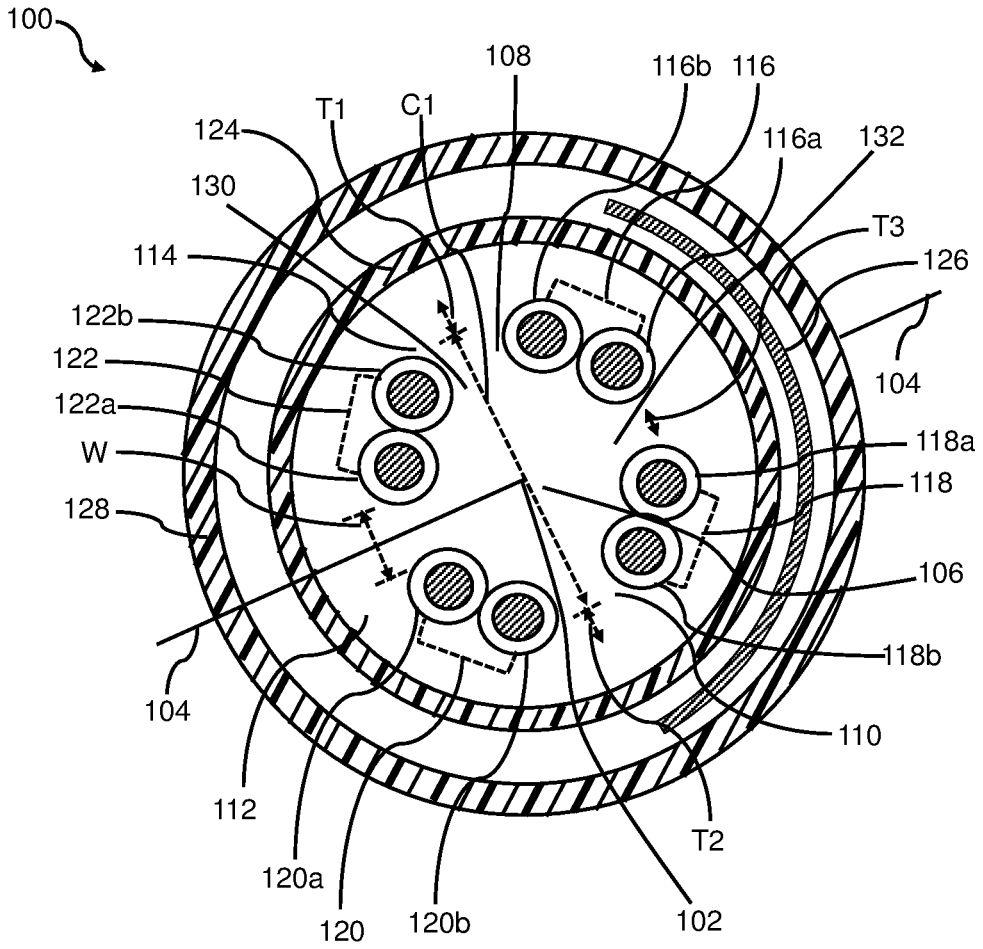
FIG. 1 illustrates a cross sectional view of a telecommunications cable, in accordance with various embodiments of the present disclosure.

It should be noted that the accompanying figures are intended to present illustrations of few exemplary embodiments of the present disclosure. These figures are not intended to limit the scope of the present disclosure. It should also be noted that accompanying figures are not necessarily drawn to scale.

REFERENCE NUMERALS IN THE DRAWINGS

For a more complete understanding of the present invention parts, reference is now made to the following descriptions:

100. Telecommunications cable.
102. Geometrical center.
104. Longitudinal axis.
106. Separator.
108. First area section.
110. Second area section.
112. Third area section.
114. Fourth area section.
116. The first twisted pair of insulated conductors.
116*a*. The first electrical conductor of the first twisted pair of insulated conductors.
116*b*. The second electrical conductor of the first twisted pair of insulated conductors.
118. The second twisted pair of insulated conductors.
118*a*. The first electrical conductor of the second twisted pair of insulated conductors.
118*b*. The second electrical conductor of the second twisted pair of insulated conductors.
120. The third twisted pair of insulated conductors.
120*a*. The first electrical conductor of the third twisted pair of insulated conductors.
120*b*. The second electrical conductor of the third twisted pair of insulated conductors.
122. The fourth twisted pair of insulated conductors.
122*a*. The first electrical conductor of the fourth twisted pair of insulated conductors.
122*b*. The second electrical conductor of the fourth twisted pair of insulated conductors.
124. First jacket.
126. Barriers.
128. Second jacket.
130. First separator arm.
132. Second separator arm.
134. Grooved edges.
C1. Cylindrical section.
W. Width.
T1. Thickness.
T2. Thickness.
T3. Thickness.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention.

Reference in this specification to "one embodiment" or "an embodiment" means that a particular feature, structure, or characteristic described in connection with the embodiment is included in at least one embodiment of the present technology. The appearance of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not other embodiments.

Reference will now be made in detail to selected embodiments of the present disclosure in conjunction with accompanying figures. The embodiments described herein are not intended to limit the scope of the disclosure, and the present disclosure should not be construed as limited to the embodiments described. This disclosure may be embodied in different forms without departing from the scope and spirit of the disclosure. It should be understood that the accompanying figures are intended and provided to illustrate embodiments of the disclosure described below and are not necessarily drawn to scale. In the drawings, like numbers refer to like elements throughout, and thicknesses and dimensions of some components may be exaggerated for providing better clarity and ease of understanding.

Moreover, although the following description contains many specifics for the purposes of illustration, anyone skilled in the art will appreciate that many variations and/or alterations to said details are within the scope of the present technology. Similarly, although many of the features of the present technology are described in terms of each other, or in conjunction with each other, one skilled in the art will appreciate that many of these features can be provided independently of other features. Accordingly, this description of the present technology is set forth without any loss of generality to, and without imposing limitations upon, the present technology.

It should be noted that the terms "first", "second", and the like, herein do not denote any order, ranking, quantity, or importance, but rather are used to distinguish one element from another. Further, the terms "a" and "an" herein do not denote a limitation of quantity, but rather denote the presence of at least one of the referenced item.

FIG. 1 illustrates a cross sectional view of a telecommunications cable 100, in accordance with an embodiment of the present disclosure. In general, the telecommunications cable is a media that allows baseband transmissions from a transmitter to a receiver. The telecommunications cable 100 is used for a wide variety of applications. The wide variety of applications include recording studios, data transmission, radio transmitters, intercoms, electronic circuit installations and the like. Moreover, the telecommunications cable 100 is used for high speed data rate transmission. The high speed data rate transmission includes 1000BASE-T (Gigabit Ethernet) and 10 GBASE-T (10-Gigabit Ethernet) or other standards. The telecommunications cable 100 is a shielded or unshielded twisted pair telecommunications cable. In general, the unshielded twisted pair telecommunications cable is a cable with two conductors twisted together. The electrical conductors are twisted together for the purposes of canceling out electromagnetic interference from external sources. The telecommunications cable 100 is associated with a longitudinal axis 104. The longitudinal axis 104 of the telecommunications cable 100 passes through a geometrical center 102 of the cross section of the telecommunications cable 100. The telecommunications cable 100 is a Category 6 cable or higher Categories. In an embodiment of the present disclosure, the telecommunications cable 100 is a Category 6A cable.

The telecommunications cable 100 includes a separator 106, a plurality of area sections 108, 110, 112, 114, a plurality of twisted pairs 116, 118, 120, 122 of insulated conductors 116*a*, 116*b*, 118*a*, 118*b*, 120*a*, 120*b*, 122*a*, 122*b*, a first jacket 124, one or more barriers 126 and a second jacket 128. The plurality of area sections 108, 110, 112, 114 includes a first area section 108, a second area section 110, a third area section 112 and a fourth area section 114. Furthermore, the plurality of twisted pair of insulated conductors 116*a* and 116*b* makes the pair 116, the plurality of twisted pair of insulated conductors 118*a* and 118*b* makes the pair 118, the plurality of twisted pair of insulated conductors 120*a* and 120*b* makes the pair 120 and the plurality of twisted pair of insulated conductors 122*a* and 122*b* makes the pair 122.

The telecommunications cable 100 includes the separator 106. In addition, the separator 106 is a piranha teeth shaped separator. The separator 106 extends along the longitudinal axis 104 of the telecommunications cable 100. The separator 106 separates each of the plurality of twisted pairs 116, 118, 120, 122 of insulated conductors 116*a*, 116*b*, 118*a*, 118*b*, 120*a*, 120*b*, 122*a*, 122*b* from each other. The separator 106 isolates each of the plurality of twisted pairs 116, 118, 120, 122 of insulated conductors 116*a*, 116*b*, 118*a*, 118*b*, 120*a*, 120*b*, 122*a*, 122*b* from each other. In an embodiment of the present disclosure, the separator 106 separates a core of the telecommunications cable 100 into the plurality of area sections 108, 110, 112, 114. Each section includes a pair of twisted insulated conductor along a length of the telecommunications cable 100. The separator 106 has a cross sectional of dumbbell with piranha teeth shaped like structure at its triangular edges. Two dumbbell shaped structure are perpendicular to each other to make the structure of the separator 106. The separator 106 has a first separator arm 130 and a second separator arm 132. The first separator arm 130 and the second separator arm 132 are positioned perpendicular to each other. Further each section of the separator 106 has a cylindrical surface and a triangular surface with piranha teeth on both triangular edges. The central or middle part of the first separator arm 130 and the second separator arm 132 is cylindrical in shape. In addition, the end parts of the first separator arm 130 and the second separator arm 132 is triangular in shape. The first separator arm 130 includes a cylindrical section C1, and two triangular sections. Similarly, the second separator arm 132 includes a cylindrical section, and two triangular sections (Not marked in Figure). The two triangular sections have piranha teeth like structure on an edge extending along the length of the telecommunications cable 100. The shape of teeth could be of any shape.

Figure 2:
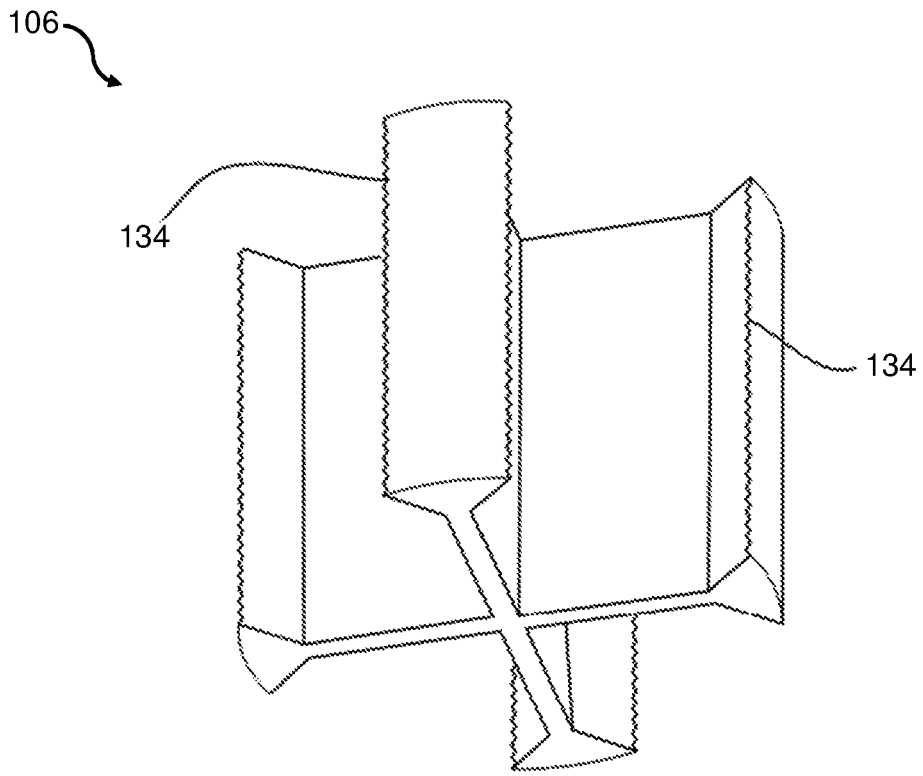
FIG. 2 illustrates a cross sectional view of a separator of the telecommunications cable of FIG. 1, in accordance with an embodiment of the present disclosure.

In addition, the first separator arm 130 and the second separator arm 132 has a length in a range of about 5.8 millimeters±0.6 millimeter. In an embodiment of the present disclosure, the separator 106 is characterized by piranha shaped teeth (grooved edges) 134 (as shown in FIG. 2). The grooved edges 134 are distributed longitudinally along a length of the separator 106.

Further, the separator 106 is characterized by a height and a width. In an embodiment of the present disclosure, the separator 106 has a height and a width in a range of about 5.8 mm±0.6 millimeter and 6 millimeter±0.6 millimeter respectively. In another embodiment of the present disclosure, the separator 106 has a height and a width in a range of about 5.8 mm±0.3 millimeter and 6 millimeter±0.3 millimeter respectively. In yet another embodiment of the present disclosure, the separator 106 may have any suitable height and width. The two triangular sections of the first separator arm 130 and the second separator arm 132 are characterized by a width W of triangular portion and a wing thickness T1 & T2. In general, the wing thickness is the distance between the upper and lower surface of the triangular portion of the separator. In an embodiment of the present disclosure, the separator 106 is made up of low smoke zero halogen. In general, low smoke zero halogen is a type of plastic used in the wire and cable industry for improving performance of cables and wires. Low smoke zero halogen is custom compound designed to produce minimal smoke and no halogen during exposure to fire. In another embodiment of the present disclosure, the separator 106 is made up of any other suitable material. The separator 106 divides the core of the telecommunications cable 100 into a plurality of area sections 108, 110, 112, 114. In an embodiment of the present disclosure, the separator 106 has a triangular portion which has the width W in a range of about 1.5 millimeter±0.6 millimeter. In another embodiment of the present disclosure, the triangular portion of the separator 106 has the width W in a range of about 1.5 millimeter±0.3 millimeter. In yet another embodiment of the present disclosure, the width W of the separator 106 may vary. In an embodiment of the present disclosure, the separator 106 has the thickness T3 in a range of about 0.4 millimeter−0.3 and 0.4 mm+0.5 mm. In another embodiment of the present disclosure, the separator 106 has the thickness T3 in a range of about 0.4 millimeter±0.2 millimeter. In yet another embodiment of the present disclosure, the thickness T3 of the separator 106 may vary.

In an embodiment of the present disclosure, the two triangular sections of the first separator arm 130 and the second separator arm 132 have a wing thickness T1 & T2 of about 0.4 millimeters. In another embodiment of the present disclosure, the two triangular sections of the first separator arm 130 and the second separator arm 132 have the wing thickness T1 & T2 of about 0.30 millimeter. In yet another embodiment of the present disclosure, the two triangular sections of the first separator arm 130 and the second separator arm 132 may have any suitable thickness T1 & T2.

The telecommunications cable 100 includes the plurality of area sections 108, 110, 112, 114. Each area of the plurality of area sections 108, 110, 112, 114 corresponds to an area separated by the separator 106. The plurality of area sections 108, 110, 112, 114 includes a first area section 108, a second area section 110, a third area section 112 and a fourth area section 114. In an embodiment of the present disclosure, the plurality of area sections 108, 110, 112, 114 corresponds to any other suitable number of area sections. In an embodiment of the present disclosure, each of the plurality of area sections 108, 110, 112, 114 are equal in cross sectional area. In another embodiment of the present disclosure, the cross sectional area of the plurality of area sections 108, 110, 112, 114 are not equal. Each area section of the plurality of area sections 108, 110, 112, 114 provides housing space for plurality of data transmission elements. Each area section of the plurality of area sections 108, 110, 112, 114 includes one pair of twisted insulated conductors. In an embodiment of the present disclosure, each area section of the plurality of area sections 108, 110, 112, 114 may include any other suitable number of pairs of twisted insulated conductors.

The telecommunications cable 100 includes the plurality of twisted pairs 116, 118, 120, 122 of insulated conductors 116*a*, 116*b*, 118*a*, 118*b*, 120*a*, 120*b*, 122*a*, 122*b*. Each of the plurality of twisted pairs of insulated conductors 116*a*, 116*b*, 118*a*, 118*b*, 120*a*, 120*b*, 122*a*, 122*b* extends substantially along the longitudinal axis 104 of the telecommunications cable 100. In an embodiment of the present disclosure, each of the plurality of twisted pairs of insulated conductors 116*a*, 116*b*, 118*a*, 118*b*, 120*a*, 120*b*, 122*a*, 122*b* is helically twisted along a length of the plurality of twisted pairs of insulated conductors 116*a*, 116*b*, 118*a*, 118*b*, 120*a*, 120*b*, 122*a*, 122*b*. The plurality of twisted pairs of insulated conductors 116*a*, 116*b*, 118*a*, 118*b*, 120*a*, 120*b*, 122*a*, 122*b* are helically twisted together to minimize the cross talk in the telecommunications cable 100. In an embodiment of the present disclosure, a number of the plurality of twisted pairs of insulated conductors 116*a*, 116*b*, 118*a*, 118*b*, 120*a*, 120*b*, 122*a*, 122*b* is 4. In another embodiment of the present disclosure, the number of the plurality of twisted pairs of insulated conductors may vary. Each of the four twisted pair of insulated conductor includes two insulated conductors twisted together along a length of the insulated conductors.

Each insulated conductor of the plurality of twisted pairs of insulated conductors 116*a*, 116*b*, 118*a*, 118*b*, 120*a*, 120*b*, 122*a*, 122*b* includes an electrical conductor and an insulation layer. In addition, each twisted pair of insulated conductor includes a first electrical conductor and a second electrical conductor. The first electrical conductor is surrounded by a first insulation layer. The second electrical conductor is surrounded by a second insulated layer. Similarly, each of the four twisted pair of insulated conductors includes a first electrical conductor surrounded by a first insulation layer and a second electrical conductor surrounded by a second insulated layer. Each electrical conductor is 23 American Wire Gauge (hereinafter AWG) conductor. In general, AWG is a standardized wire gauge system. The value of wire gauge indicates the diameter of the conductors in the cable.

The electrical conductor is characterized by a cross-sectional diameter. In an embodiment of the present disclosure, the electrical conductor has a cross sectional diameter in a range of about 0.560 millimeter±0.050 millimeter. In another embodiment of the present disclosure, the electrical conductor has the cross sectional diameter in a range of about 0.560 millimeter±0.1 millimeter. In yet another embodiment of the present disclosure, the cross sectional diameter of the electrical conductor may vary.

The insulation layer is characterized by a cross-sectional diameter. In an embodiment of the present disclosure, the insulation layer has a cross sectional diameter in a range of about 1.03 millimeter±0.2 millimeter. In another embodiment of the present disclosure, the insulation layer has the cross sectional diameter in a range of about 1.03 millimeter±0.05 millimeter. In yet another embodiment of the present disclosure, the cross sectional diameter of the insulation layer may vary. In general, insulated conductors are used in many categories of data transmission, telecommunication, electrical wiring, power generation, power transmission, power distribution, electronic circuitry. In an embodiment each electrical conductors is of circular shape. In another embodiment of the present disclosure, each of the insulated conductors has any other suitable shape.

The plurality of twisted pairs of insulated conductors 116*a*, 116*b*, 118*a*, 118*b*, 120*a*, 120*b*, 122*a*, 122*b* includes the first twisted pair of insulated conductors 116, the second twisted pair of insulated conductors 118 and the third twisted pair of insulated conductors 120. In addition, the plurality of twisted pairs of insulated conductors 116*a*, 116*b*, 118*a*, 118*b*, 120*a*, 120*b*, 122*a*, 122*b* includes the fourth twisted pair of insulated conductors 122. Further, each pair of the plurality of twisted pairs of insulated conductors 116*a*, 116*b*, 118*a*, 118*b*, 120*a*, 120*b*, 122*a*, 122*b* is positioned inside a separate section of the plurality of area sections 108, 110, 112, 114. The first twisted pair of insulated conductor 116*a*, 116*b* is positioned in the first area section 108. The second twisted pair of insulated conductor 118*a*, 118*b* is positioned in the second area section 110. The third twisted pair of insulated conductor 120*a*, 120*b* is positioned in the third area section 112. The fourth twisted pair of insulated conductor 122*a* 122*b* are positioned in the fourth area section 114. Each pair of twisted insulated conductors includes two insulated conductors.

The telecommunications cable 100 includes a plurality of insulated conductors. The first twisted pair 116 of insulated conductors includes a first electrical conductor 116*a* and a second electrical conductor 116*b*. The first electrical conductor and the second electrical conductor of the first twisted pair 116 of insulated conductors are having the insulation layer of polyolefin and/or fluoropolymer. In general, the insulation layer surrounds the electrical conductor. The insulations are used in electrical equipment to support and separate electrical conductors. In addition, the first electrical conductor of the first twisted pair of insulated conductors 116*a* is having the insulation layer of blue color. Further, the second electrical conductor of the first twisted pair of insulated conductors 116*b* is having the insulation layer of white color with blue stripe.

The second twisted pair 118 of insulated conductors includes a first electrical conductor 118*a* and a second electrical conductor 118*b*. The first electrical conductor and the second electrical conductor of the second twisted pair 118 of insulated conductors are having the insulation layer of made up of polyolefin and/or fluoropolymer. In addition, the first electrical conductor of the second twisted pair of insulated conductors 118*a* has the insulation layer of orange color. Further, the second electrical conductor of the second twisted pair of insulated conductors 118*b* has the insulation layer of white color with orange stripe.

The third twisted pair 120 of insulated conductors includes a first electrical conductor 120*a* and a second electrical conductor 120*b*. The first electrical conductor and the second electrical conductor of the third twisted pair 120 of insulated conductors are having the insulation layer of made up of polyolefin and/or fluoropolymer. In addition, the first electrical conductor of the third twisted pair of insulated conductors 120*a* has the insulation layer of green color. Further, the second electrical conductor of the third twisted pair of insulated conductors 120*b* has the insulation layer of white color with green stripe.

The fourth twisted pair 122 of insulated conductors includes a first electrical conductor 120*a* and a second electrical conductor 120*b*. The first electrical conductor and the second electrical conductor of the fourth twisted pair 122 of insulated conductors are having the insulation layer made of polyolefin and/or fluoropolymer. In addition, the first electrical conductor of the fourth twisted pair of insulated conductors 122*a* has the insulation layer of brown color. Further, the second electrical conductor of the fourth twisted pair of insulated conductors 122*b* has the insulation layer of white color with brown stripe.

In an embodiment, the color of insulation layer over the plurality of twisted pair of insulated conductors 116*a*, 116*b*, 118*a*, 118*b*, 120*a*, 120*b*, 122*a*, 122*b* may vary according to the requirement. In general, the insulation layer surrounds each of the plurality of electrical conductors. The insulation layer is a protective coating layer over the corresponding electrical conductors. The insulation layer provides electrical isolation for each of the plurality of electrical conductors. In an embodiment, the insulation layer over the plurality of twisted pair of insulated conductors 116*a*, 116*b*, 118*a*, 118*b*, 120*a*, 120*b*, 122*a*, 122*b* may be of any suitable material.

Each insulated conductor of the plurality of twisted pair of insulated conductors 116*a*, 116*b*, 118*a*, 118*b*, 120*a*, 120*b*, 122*a*, 122*b* is characterized by an elongation property. In general elongation of conductor corresponds to a maximum percentage of degree to which a material may be bent stretched or compressed before it ruptures. In an embodiment of the present disclosure, each insulated conductor of the plurality of twisted pair of insulated conductors 116*a*, 116*b*, 118*a*, 118*b*, 120*a*, 120*b*, 122*a*, 122*b* has an elongation in a range of about 14-24% of the original length of the conductor. In another embodiment of the present disclosure, each insulated conductor of the plurality of twisted pair of insulated conductors 116*a*, 116*b*, 118*a*, 118*b*, 120*a*, 120*b*, 122*a*, 122*b* may have any suitable value of elongation.

In an embodiment of the present disclosure, each insulation layer of the plurality of twisted pair of insulated conductors 116*a*, 116*b*, 118*a*, 118*b*, 120*a*, 120*b*, 122*a*, 122*b* is made of polyolefin and/or fluoropolymer.

The telecommunications cable 100 includes the first jacket 124. The first jacket 124 includes a jacket body. The body of the first jacket 124 extends substantially along the longitudinal axis 104 of the telecommunications cable 100. The longitudinal axis 104 of the telecommunications cable 100 passes through the geometrical center 102 of the telecommunications cable 100. The first jacket 124 surrounds the plurality of twisted pairs 116, 118, 120, 122 of insulated conductors 116*a*, 116*b*, 118*a*, 118*b*, 120*a*, 120*b*, 122*a*, 122*b* extending substantially along the longitudinal axis 104 of the telecommunications cable 100. The first jacket 124 is an inner jacketing layer of the telecommunications cable 100. The first jacket 124 is the protective inner covering for the telecommunications cable 100. The first jacket 124 provides thermal insulation and electrical insulation to the telecommunications cable 100. The first jacket 124 provides mechanical protection to the telecommunications cable 100. The first jacket 124 protects the telecommunications cable 100 from moisture, water, insects, abrasion, physical damage, magnetic fields, radiations and the like.

In an embodiment of the present disclosure, the first jacket 124 is made of one of low smoke zero halogen or Polyvinyl chloride or any other polymer material. In another embodiment of the present disclosure, the first jacket 124 is made of any other suitable material. In an embodiment of the present disclosure, the first jacket 124 and the second jacket 128 have a thickness in a range of about 0.4±0.2 millimeter. In another embodiment of the present disclosure, the first jacket 124 and the second jacket 128 have a thickness in a range of about 0.5±0.4 millimeter. In yet another embodiment of the present disclosure, the thickness of the first jacket 124 and the second jacket 128 may vary.

The telecommunications cable 100 includes the second jacket 128. The second jacket 128 includes a jacket body. The body of the second jacket 128 extends substantially along the longitudinal axis 104 of the telecommunications cable 100. The longitudinal axis 104 of the telecommunications cable 100 passes through the geometrical center 102 of the telecommunications cable 100. The second jacket 128 surrounds the first jacket 124 and the one or more barriers 126 substantially along the longitudinal axis 104 of the telecommunications cable 100. The second jacket 128 partially surrounds the one or more barriers 126. The second jacket 128 is an outer jacketing layer of the telecommunications cable 100. The second jacket 128 is the protective outer covering for the telecommunications cable 100. The second jacket 128 provides thermal insulation and electrical insulation to the telecommunications cable 100. The second jacket 128 provides mechanical protection to the telecommunications cable 100. The second jacket 128 protects the telecommunications cable 100 from moisture, water, insects, abrasion, physical damage, magnetic fields, radiations and the like.

In an embodiment of the present disclosure, the second jacket 128 is made of one of low smoke zero halogen or Polyvinyl chloride or any other polymer material. In another embodiment of the present disclosure, the second jacket 128 is made of any other suitable material.

Further, the telecommunications cable 100 includes the one or more barriers 126. The one or more barriers 126 are positioned between the first jacket 124 and the second jacket 128. The one or more barriers 126 are placed longitudinally between the first jacket 124 and the second jacket 128. The one or more barriers 126 partially surround the first jacket 124. The one or more barriers 126 result in a gap between the first jacket 124 and the second jacket 128. The one or more barriers 126 are a non-overlapping barrier. The one or more barriers 126 are made of Polyester-Aluminium Polyester material (PET-AL-PET). The one or more barriers 126 are formed of a tape made of the Polyester-Aluminium Polyester material (PET-AL-PET). The Polyester-Aluminium Polyester material (PET-AL-PET) creates a protective barrier around the twisted pair of conductors in order to prevent electromagnetic and electrostatic interference from reducing signal quality. The Polyester-Aluminium Polyester material (PET-AL-PET) tape is a flexible and shielding tape.

The Polyester-Aluminium Polyester material (PET-AL-PET) is a multilayer material with a first material layer made of polyester, a second material layer made of aluminium and a third material layer made of polyester. The first material layer, the second material layer, and the third material layer are continuous thin films. The second material layer surrounds the first material layer. The third material layer surrounds the second material layer. In an embodiment of the present disclosure, the first material layer has a width in a range of about 12 micron±6 micron. In an embodiment of the present disclosure, the second material layer has a width in a range of about 25 micron±7 micron. In an embodiment of the present disclosure, the third material layer has a width in a range of about 12 micron±6 micron.

The telecommunications cable 100 is characterized by a diameter of about 7.6 millimeters±0.5 millimeter. In an embodiment of the present disclosure, the diameter of the telecommunications cable 100 lies in any other suitable range. The telecommunications cable 100 has a specially designed twin jacket structure with barrier which provides protection against cross talk from surrounding cables at all frequency range. The twin jacket results in increase in distance of jacket from the conductor pairs of the same cable and from the surrounding cables. In addition, the twin jacket restricts movement of pairs inside the cable. Moreover, the twin jacket with the barrier provides firm packing of bunched pairs inside the cable. Further, the twin jacket with the barrier supports the alignment of separator with pairs. Furthermore, the twin jacket with the barrier provides more air between the pairs and the external cable. Also, the non-overlapping barrier gives the low unbalanced capacitance. In addition, the non-overlapping barrier gives the reduction of the material usage. Also, the non-overlapping barrier provides the Faradays cage. Further, the telecommunications cable has an overall reduced cable diameter due to less material consumption.

The above combination of structural elements enables an improvement in a plurality of characteristics of the telecommunications cable 100. The plurality of characteristics includes electrical properties and transmission characteristics. The electrical properties include input impedance, conductor resistance, mutual capacitance, resistance unbalance, capacitance unbalance, propagation delay and delay skew. The transmission characteristics include attenuation, return loss, near end crosstalk, attenuation to crosstalk ratio far end, alien cross talk, power sum attenuation to crosstalk ratio at far end.

In general, the input impedance is the ratio of the amplitudes of voltage and current of a wave travelling in one direction in the absence of reflections in the other direction. In an embodiment of the present disclosure, the input impedance of the telecommunications cable 100 is 100 ohm±15 ohm. In another embodiment of the present disclosure, the telecommunications cable 100 has any other suitable value of input impedance. In general, the conductor resistance is an electrical quantity that measures how the device or material reduces the electric current flow through it. In an embodiment of the present disclosure, the conductor resistance of the telecommunications cable 100 is less than or equal to 9.38 ohm per 100 meters at 20° C. In another embodiment of the present disclosure, the telecommunications cable 100 has any other suitable value of the conductor resistance.

In an embodiment of the present disclosure, the mutual capacitance of the telecommunications cable 100 is less than 5.6 nanofarad per 100 meters at 1000 Hz. In another embodiment of the present disclosure, the telecommunications cable 100 has any other suitable value of the mutual capacitance. In general, the mutual capacitance is intentional or unintentional capacitance taking place between two charge-holding objects or conductors in which the current passing through one passes over into the other conductor. In an embodiment of the present disclosure, the telecommunications cable 100 has the resistance unbalance of maximum 5 percent. In another embodiment of the present disclosure, the telecommunications cable 100 has any other suitable value of the resistance unbalance. In general, the resistance unbalance is a measure of the difference in resistance between two conductors in a cabling system.

In an embodiment of the present disclosure, the capacitance unbalance of the telecommunications cable 100 is 330 Pico farad per 100 meter at 1000 Hz. In another embodiment of the present disclosure the telecommunications cable 100 has any other suitable value of capacitance unbalance. In general, capacitance unbalance is a measure of difference in capacitance between two conductors in a cabling system. In an embodiment of the present disclosure, the delay skew of the telecommunications cable 100 is less than 45 nanoseconds per 100 meters at 1 MegaHertz. In another embodiment of the present disclosure, the telecommunications cable 100 has any other suitable value of the delay skew. In general, delay skew is a difference in propagation delay between any two conductor pairs within the same cable.

In general, the attenuation to cross talk ratio far end is a measure of signal received at the far end of the telecommunications cable 100. The ratio provides an indication of the interfering signal induced by adjacent conductor pairs in the same telecommunications cable 100. The alien crosstalk is electromagnetic noise occurring in a telecommunications cable 100 running alongside one or more other signal-carrying cables. The term "alien" is used as alien crosstalk occurs between different cables in a group or bundle and not between individual wires or circuits within a single cable. The power sum alien near end crosstalk (PSANEXT) is a measurement of interference generated in a test cable by a number of surrounding cables.

The telecommunications cable 100 transmits data at a plurality of operational frequencies. The plurality of operational frequencies includes 1 MegaHertz (hereinafter MHz), 4 MHz, 10 MHz, 16 MHz, 20 MHz, 31.25 MHz, 62.5 MHz, 100 MHz, 200 MHz, 250 MHz, 300 MHz and 500 MHz.

In an embodiment of the present disclosure, the maximum attenuation of the telecommunications cable 100 is 2.1 decibels (hereinafter dB) per 100 meters at 1 MHz. In general, attenuation refers to reduction in the strength of a signal travelling through telecommunications cable. In an embodiment of the present disclosure, the return loss of the telecommunications cable 100 is 20 dB at 1 MHz. In general, return loss is the measurement of the amount of signal that is reflected back toward the transmitter. In an embodiment of the present disclosure, the near end crosstalk of the telecommunications cable 100 is 74.3 dB at 1 MHz. In general, the near end crosstalk is an error condition describing the occurrence of a signal from one wire pair radiating to and interfering with the signal of another wire pair. In an embodiment of the present disclosure, the power sum near end crosstalk of the telecommunications cable 100 is 72.3 dB at 1 MHz. In general, power sum near end crosstalk (PSNEXT) is the algebraic sum of near end crosstalk. In addition, power sum near end crosstalk is measured at the same end of the cable as the interfering transmitter.

In an embodiment of the present disclosure, the attenuation to crosstalk ratio far end of the telecommunications cable 100 is 67.8 dB at 1 MHz. In an embodiment of the present disclosure, the power sum attenuation to crosstalk ratio far end of the telecommunications cable 100 is 64.8 dB at 1 MHz. In another embodiment of the present disclosure, the telecommunications cable 100 may have any other suitable value of the transmission characteristics at 1 MHz.

In yet another embodiment of the present disclosure, the maximum attenuation of the telecommunications cable 100 is 5.9 dB per 100 meters at 10 MHz. In yet another embodiment of the present disclosure, the return loss of the telecommunications cable 100 is 25 dB at 10 MHz. In yet another embodiment of the present disclosure, the near end crosstalk of the telecommunications cable 100 is 59.3 dB at 10 MHz. In yet another embodiment of the present disclosure, the power sum near end crosstalk of the telecommunications cable 100 is 57.3 dB at 10 MHz. In yet another embodiment of the present disclosure, the attenuation to crosstalk ratio far end of the telecommunications cable 100 is 47.8 dB at 10 MHz. In yet another embodiment of the present disclosure, the power sum attenuation to crosstalk ratio far end of the telecommunications cable 100 is 44.8 dB at 10 MHz. In yet another embodiment of the present disclosure, the transmissions cable 100 may have any other suitable value transmission characteristics at 10 MHz.

In yet another embodiment of the present disclosure, the maximum attenuation of the telecommunications cable 100 is 19.1 dB per 100 meters at 100 MHz. The return loss of the telecommunications cable 100 is 20.1 dB at 100 MHz. The near end crosstalk of the telecommunications cable 100 is 44.3 dB at 100 MHz. The power sum near end crosstalk of the telecommunications cable 100 is 42.3 dB at 100 MHz. The attenuation to crosstalk ratio far end of the telecommunications cable 100 is 27.8 dB at 100 MHz. The power sum attenuation to crosstalk ratio far end of the telecommunications cable 100 is 24.8 dB at 100 MHz. In yet another embodiment of the present disclosure, the telecommunications cable 100 may have any other suitable value transmission characteristics at 100 MHz.

In yet another embodiment of the present disclosure, the maximum attenuation of the telecommunications cable 100 is 31.1 dB per 100 meters at 250 MHz. In yet another embodiment of the present disclosure, the return loss of the telecommunications cable 100 is 17.3 dB at 250 MHz. In yet another embodiment of the present disclosure, the near end crosstalk of the telecommunications cable 100 is 38.3 dB at 250 MHz. In yet another embodiment of the present disclosure, the power sum near end crosstalk of the telecommunications cable 100 is 36.3 dB at 250 MHz. In yet another embodiment of the present disclosure, the attenuation to crosstalk ratio far end of the telecommunications cable 100 is 19.8 dB at 250 MHz. In yet another embodiment of the present disclosure, the power sum attenuation to crosstalk ratio far end of the telecommunications cable 100 is 16.8 dB at 250 MHz. In yet another embodiment of the present disclosure, the telecommunications cable 100 may have any other suitable value transmission characteristics at 250 MHz.

In yet another embodiment of the present disclosure, the maximum attenuation of the telecommunications cable 100 is 45.3 dB per 100 meters at 500 MHz. In yet another embodiment of the present disclosure, the return loss of the telecommunications cable 100 is 15.2 dB at 500 MHz. In yet another embodiment of the present disclosure, the near end crosstalk of the telecommunications cable 100 is 33.8 dB at 500 MHz. In yet another embodiment of the present disclosure, the power sum near end crosstalk of the telecommunications cable 100 is 31.8 dB at 500 MHz. In yet another embodiment of the present disclosure, the attenuation to crosstalk ratio far end of the telecommunications cable 100 is 13.8 dB at 500 MHz. In yet another embodiment of the present disclosure, the power sum attenuation to crosstalk ratio far end of the telecommunications cable 100 is 10.8 dB at 500 MHz. In yet another embodiment of the present disclosure, the telecommunications cable 100 may have any other suitable value transmission characteristics at 500 MHz.

The present disclosure provides numerous advantages over the prior art. The telecommunications cable provides protection against alien cross talk from surrounding cables at all frequency ranges. In addition, the telecommunications cable provides improvement in alien cross talk and also facilitates in meeting international standard limits. Special barrier tape acts as barrier to the electromagnetic interference from the neighboring cables. The telecommunications cable with increased air gap enables an improvement in electrical properties. The telecommunications cable has structural elements that enable improvement in overall installation efficiency. The telecommunications cable increases the data transmissions speed. Further, the transmission cable with piranha separator and the twin jacket facilitates in reducing diameter of the transmission cable. Moreover, the telecommunications cable provides protection to the plurality of twisted pair of insulated conductors against any external impact. Also, the telecommunications cable is used for transmission of high speed data used to provide digital and analogue voice and video (RGB) signals on LANs, Supports Gigabit Ethernet (10 GbaseT) standard and operates at bandwidth of 500 MHz.

The foregoing descriptions of specific embodiments of the present technology have been presented for purposes of illustration and description. They are not intended to be exhaustive or to limit the present technology to the precise forms disclosed, and obviously many modifications and variations are possible in light of the above teaching. The embodiments were chosen and described in order to best explain the principles of the present technology and its practical application, to thereby enable others skilled in the art to best utilize the present technology and various embodiments with various modifications as are suited to the particular use contemplated. It is understood that various omissions and substitutions of equivalents are contemplated as circumstance may suggest or render expedient, but such are intended to cover the application or implementation without departing from the spirit or scope of the claims of the present technology.

Although the present disclosure has been explained in relation to its preferred embodiment(s) as mentioned above, it is to be understood that many other possible modifications and variations can be made without departing from the spirit and scope of the inventive aspects of the present invention. It is, therefore, contemplated that the appended claim or claims will cover such modifications and variations that fall within the true scope of the invention.

We claim:

1. A telecommunications cable comprising:

a plurality of twisted pairs of insulated conductors extending substantially along a longitudinal axis of the telecommunications cable;

a separator, wherein the separator separates each of the plurality of twisted pairs of insulated conductors;

a first jacket;

a second jacket; and one or more barriers, wherein the one or more barriers are positioned between the first jacket and the second jacket, wherein the one or more barriers partially surround the first jacket resulting in a gap between the first jacket and the second jacket, wherein the one or more barriers are a non-overlapping barrier.

2. The telecommunications cable as claimed in claim 1, wherein the one or more barriers are placed longitudinally between the first jacket and the second jacket to partially surround the first jacket.

3. The telecommunications cable as claimed in claim 1, wherein the one or more barriers are made of Polyester-Aluminium Polyester (PET-AL-PET) material.

4. The telecommunications cable as claimed in claim 1, wherein the one or more barriers are made of the Polyester-Aluminium Polyester (PET-AL-PET), wherein the Polyester-Aluminium Polyester (PET-AL-PET) material has a first material layer, a second material layer, and a third material layer, wherein the first material layer has a thickness in a range of 12 micron±5 micron, wherein the second material layer has a thickness in a range of 25 micron±10 micron, wherein the third material layer has a thickness in a range of 12 micron±5 micron.

5. The telecommunications cable as claimed in claim 1, wherein each of the one or more barriers has a width of at least 5 millimeter.

6. The telecommunications cable as claimed in claim 1, wherein the plurality of twisted pairs of insulated conductors comprises an insulation layer, wherein the insulation layer is made of a material selected from a group of fluoropolymer and polyolefin.

7. A telecommunications cable comprising:

a plurality of twisted pairs of insulated conductors extending substantially along a longitudinal axis of the telecommunications cable;

a first jacket;

a second jacket;

a separator comprising:

a first separator arm extending along a length of the telecommunications cable; and a second separator arm extending along the length of the telecommunications cable, wherein the first separator arm and the second separator arm are positioned perpendicular to each other, wherein the first separator arm and the second separator arm of the separator comprises a cylindrical section, and two triangular sections, wherein the cylindrical section, and the two triangular sections form a dumbbell shape structure, wherein the two triangular sections have a piranha teeth like structure on an edge extending along the length of the telecommunications cable.

8. The telecommunications cable as claimed in claim 7, wherein consecutive teeth of the piranha teeth like structure on the edge of the two triangular sections has a distance in a range of 0.10 millimeter to 1.09 millimeter, wherein the piranha teeth like structure on the edge of the two triangular sections has a height in a range of 0.09 millimeter to 0.8 millimeter.

9. A telecommunications cable comprising:

a first jacket and a second jacket, wherein the first jacket and the second jacket extend substantially along a longitudinal axis of the telecommunications cable, wherein the first jacket and the second jacket are made of a material selected from a group consisting of low smoke zero halogen material, polyvinyl chloride material, and any other polymer material, wherein one or more barriers are positioned between the first jacket and the second jacket, wherein the one or more barriers have a width of at least 5 millimeter.

10. The telecommunications cable as claimed in claim 9, wherein the first jacket and the second jacket have a thickness in a range of 0.5±0.4 millimeter.

* * * * *